US005193509A

United States Patent [19]

Ohmori et al.

[11] Patent Number: 5,193,509

[45] Date of Patent: Mar. 16, 1993

[54] FUEL CONTROL SYSTEM FOR AUTOMOTIVE POWER PLANT

[75] Inventors: Masashi Ohmori; Yasuhiro Harada; Shinichi Wakutani; Hiroshi Ebino, all of Hiroshima, Japan

[73] Assignee: Mazda Motor Corporation, Hiroshima, Japan

[21] Appl. No.: 848,084

[22] Filed: Mar. 9, 1992

[30] Foreign Application Priority Data

Mar. 30, 1991 [JP] Japan ..... 3-67347

[51] Int. Cl.[5] ..... F02D 41/12

[52] U.S. Cl. ..... 123/493

[58] Field of Search ..... 123/478, 492, 493

[56] References Cited

U.S. PATENT DOCUMENTS

| | | | |
|---|---|---|---|
| 4,359,993 | 11/1982 | Carlson | 123/493 |
| 4,512,318 | 4/1985 | Ito et al. | 123/493 |
| 4,523,571 | 6/1985 | Yamato et al. | 123/493 |
| 4,548,181 | 10/1985 | Ishikawa et al. | 123/493 |
| 4,781,163 | 11/1988 | Jautelat et al. | 123/493 |
| 4,984,552 | 1/1991 | Nishizawa et al. | 123/492 |

*Primary Examiner*—Willis R. Wolfe
*Attorney, Agent, or Firm*—Fish & Richardson

[57] ABSTRACT

In an automotive power plant including a combustion engine, intake and exhaust passages communicated with a combustion chamber for an introduction of an air-fuel mixture into and a discharge of exhaust gases from the combustion chamber, respectively, a fuel injector for injecting a controlled amount of fuel into the combustion chamber together with air sucked through the intake passage, and a throttle valve of which opening is adjustable for controlling the flow of the air through the intake passage, a fuel control system for determining the amount of fuel to be injected into the combustion chamber in dependence on the amount of air being sucked. The fuel control system includes a throttle sensor for detecting the opening of the throttle valve; and a control unit operable to determine a first fuel decrement in dependence on the amount of fuel injected at the start of a decrease in throttle opening during a deceleration of the engine when the throttle sensor detects the decrease in throttle opening at a speed higher than a predetermined value and regardless of a speed of movement of the throttle valve; to interrupt the determination of the first fuel decrement when the rate of change of the throttle valve attains a zero value; and thereafter to determine a second fuel decrement in dependence on a change in load on the engine.

9 Claims, 6 Drawing Sheets

| TVOAH1-TVOAH2 | 10 | 20 | ---- | 70 |
|---|---|---|---|---|
| TGTVOA1-2 | Small ——— | | | Great |

Fig. 6

| ΔTVOAHI \ TVOAHI (%) | 0 | 10 | 20 | ---70 |
|---|---|---|---|---|
| 0 | --- | --- | --- | ------ |
| 10 | | --- | --- | ------ |
| 20<br>30 | | | --- | ------ |
| ⋮<br>70 | | | | ⋮<br>1 |

Fig. 7

| MAPHI (mmHg) \ NEHI (rpm) | 1000 | 2000 | --- | 8000 |
|---|---|---|---|---|
| -400 | --- | --- | --- | --- |
| -200 | ⋮ | ⋮ | ⋮ | ⋮ |
| ⋮ | ⋮ | ⋮ | ⋮ | ⋮ |
| 0 | ⋮ | ⋮ | ⋮ | ⋮ |
| ⋮ | 1 | 1 | 1 | 1 |
| +600 | 1 | 1 | 1 | 1 |

Fig. 8

| TVOAH1-TVOAH2 / TVOAH2 | 10 | ------ | 70 |
|---|---|---|---|
| 10 | S | ——— | L |
| ⋮ | ⋮ | ⋮ | ⋮ |
| 70 | L | ------ | ⋮ |

S: Short
L: Long

Fig. 9

| NEH2 / MAPH2 | 1000 | 2000 | --- | 8000 |
|---|---|---|---|---|
| -400 | -- | -- | -- | -- |
| -200 | ⋮ | ⋮ | ⋮ | ⋮ |
| +600 | -- | -- | -- | -- |

Fig. 10

| MAPH1-2 (mmHg) | 0 | 200 | --- | 1200 |
|---|---|---|---|---|
| TGDMAP2 | Small ——— | | | Great |

FUEL CONTROL SYSTEM FOR AUTOMOTIVE POWER PLANT

BACKGROUND OF THE INVENTION

1. Field of the Invention

The present invention generally relates to an automotive power plant and, more particularly, to a fuel control system for an automobile internal combustion engine designed to reducing quickly and properly the amount of fuel to be injected into the combustion chamber during an deceleration of the combustion engine.

2. Description of the Prior Art

With the progress of an electronic technology, a majority of recent models of automotive power plants employ a fuel injection system in place of a carburetor system. As is well known to those skilled in the art, the fuel injection system includes a fuel injector operable under a control of a control unit such as a microcomputer to inject a controlled amount of fuel into the combustion chamber. The control unit performs a calculation based on the amount of air flowing through an air intake passage leading to the engine, so that an air-fuel mixture of an air-fuel mixing ratio appropriate to the particular engine operating condition can be eventually supplied into the combustion chamber to achieve a proper combustion of the air-fuel mixture.

In this well known system, the use has been made of an air flow sensor disposed on the air intake passage intermediate between an air suction opening or an air cleaner and a throttle valve for detecting, and providing the control unit with an air signal indicative of, the amount of air actually flowing through the air intake passage. So far as the air signal outputted from the air flow sensor is utilized to permit the control unit to calculate the amount of fuel to be injected and then to drive the fuel injector, it has often been observed that a deviation occurs between the fuel injection timing, at which the controlled amount of fuel is actually injected, and the timing at which the air flowing through the air intake passage actually reaches the combustion chamber, due to, for example, a delay in detecting the amount of air flowing in the air intake passage and/or a delay of the control unit to complete the required calculation.

The deviation referred to above is substantially considerable particularly during the acceleration and deceleration of the combustion engine, and it is not infrequent that the amount of fuel injected during the acceleration becomes short of the requirement and that, during the deceleration, the amount of fuel injected becomes excessive relative to the amount of air supplied into the combustion chamber, that is, the air-fuel mixture becomes enriched. The supply of an insufficient fuel into the combustion chamber such as occurring during the acceleration of the engine may lead to a failure of the air-fuel mixture to burn properly and, on the other hand, the supply of the enriched air-fuel mixture such as occurring during the deceleration may result in not only a failure of the air-fuel mixture to burn properly, but also an after-burning in an exhaust system.

To avoid the problems discussed above, it has been suggested to employ the throttle opening, i.e., the opening of a throttle valve adjustable within the air intake passage between a full open position and a substantially closed position, as a parameter by which any one of the amount of air to be supplied into the combustion chamber and the amount of fuel to be injected into the combustion chamber can be corrected or rectified to eventually provide a properly adjusted air-fuel mixture. By way of example, the Japanese Laid-open Patent Publication No. 62-223432 published Oct. 1, 1987, deals with the problems which would occur during the deceleration of the combustion engine. According to this publication, it is suggested to determine, in reference to the throttle opening, a load imposed on the engine shortly before the deceleration takes place and then to increase the amount of air supplied into the combustion chamber thereby to avoid an enrichment of the air-fuel mixture.

On the other hand, the Japanese Laid-open Patent Publication No. 62-206246 published Sep. 10, 1987, deals with the problems which would occur during the acceleration of the combustion engine. According to this publication, it is suggested to estimate, based on the throttle opening, the amount of air which would be supplied into the combustion chamber, so that the amount of fuel to be injected into the combustion chamber during the acceleration can be increased in dependence on the difference between the estimated amount of air and the amount of air actually detected by the air-flow sensor.

In any event, the conventional fuel control system for the internal combustion engine is so designed and so structured that the amount by which the fuel to be injected into the combustion chamber is adjusted (which amount is hereinafter referred to as an amount of correction of the fuel) to eventually provide the air-fuel mixture of a proper mixing ratio appropriate to a particular engine operating condition can be calculated in reference to an amount of change of the throttle opening during the deceleration and, therefore, a delay in fuel injection timing tends to occur to an extent corresponding to the time during which the calculation takes place. This delay tends to result in a failure of the air-fuel mixture to burn properly or an occurrence of the after-burning in the exhaust system.

If the amount by which the fuel is adjusted, i.e., the amount of correction of the fuel, in an attempt to provide the air-fuel mixture of a proper mixing ratio appropriate to the decelerating condition of the engine is fixed at a constant value, the above discussed problem may be substantially eliminated. However, this contemplated method would not result in the mixing of fuel with air in a proportion appropriate to the deceleration of the engine with the combustibility thereof deteriorated consequently.

In view of the foregoing, in order to minimize or substantially eliminate any possible occurrence of the after-burning in the exhaust passage or the failure of the air-fuel mixture to burn within the combustion chamber during the deceleration of the engine, the amount of fuel being injected has to be reduced as quickly as possible at an early stage of a return of the throttle valve towards the closed position within the air intake passage, or the amount of correction of the fuel will not follow up a change in amount of air being sucked towards the combustion chamber.

On the other hand, in order to achieve an accurate reduction in amount of the fuel being injected it is necessary to reduce the amount of fuel in proportion to a change in load on the engine. However, if the amount of fuel is reduced in proportion to the change in load on the engine, a similar problem would occur, that is, the amount of correction of the fuel will not quickly follow up a change in amount of air being sucked towards the combustion chamber.

SUMMARY OF THE INVENTION

In view of the foregoing, the present invention has been devised with a view to substantially eliminating the above discussed problems inherent in the prior art automotive power plants and is intended to provide an improved fuel control system for the automotive engine which is capable of accomplishing an accurate and quick reduction in amount of fuel to be injected during the deceleration of the engine.

To this end, the fuel control system embodying the present invention is of a type capable of determining the amount of fuel to be injected into the combustion chamber in dependence on the amount of air being sucked towards the combustion chamber. The fuel control system referred to above comprises a throttle sensing means for detecting, and providing a throttle signal indicative of, the opening of the throttle valve disposed in the air intake passage and adjustable between the full open position and the substantially closed position, and a control means which is operable to determine, and control the fuel injector so as to reduce the fuel to be injected by, a first amount of fuel to be reduced (which is hereinafter referred to as a first fuel decrement) in dependence on the amount of fuel injected at the start of movement of the throttle valve towards the closed position during the deceleration of the engine in the event that the throttle sensing means detects the movement of the throttle valve towards the closed position at a speed higher than a predetermined value and regardless of a speed of movement of the throttle valve towards the closed position; to interrupt the determination of the first fuel decrement at the time when the rate of change of the throttle valve towards the closed position attains a zero value; and thereafter to determine, and control the fuel injector so as to reduce the fuel by, a second fuel decrement, i.e., a second amount of fuel to be reduced, in dependence on a change in load on the engine.

According to the present invention, in order to accomplish the reduction of the fuel as accurately as possible, the second fuel decrement has to be determined on the basis of the first fuel decrement. In other words, based on the first fuel decrement and the amount of change in throttle opening subsequent to the start of the change thereof and until the termination of the change thereof, the greater the amount of change in throttle opening, the greater the second fuel decrement. Then, after the change in throttle opening has terminated, the amount of fuel to be injected is reduced by the second fuel decrement.

Where the amount of the fuel is reduced during the deceleration of the engine in accordance with the teachings of the present invention, it may occur that a calculation of the amount of fuel to be injected will result in a value not greater than zero particularly during an engine operating condition, for example, an idling condition, in which the amount of air sucked into the combustion chamber is small. In such case, because any fuel injection pulse used to drive the fuel injector and bearing a negative sign cannot be formulated and because fuel adhering to a wall surface of a fuel supply system will affects, no sufficient reduction in amount of fuel can be accomplished. In addition, the use of a correction logic for reducing the amount of fuel to be injected during the deceleration, which may be similar to, but a reverse version of, a correction logic for increasing the amount of fuel to be injected during the acceleration does not result in a sufficient control.

Accordingly, in the practice of the present invention, the fuel control system is preferably so designed that, where the actual calculation of the amount of fuel to be injected during the engine operating condition in which the amount of air being sucked is small results in a value not greater than zero, the fuel decrement by which the amount of fuel to be injected into the combustion chamber is chosen to be of a value effective to render the result of calculation to be zero and, at the time, the length of time during which the amount of the fuel being injected is reduced is prolonged.

As is well known to those skilled in the art, most of the automotive engine systems are equipped with an idling speed control device operable to adjust the amount of air being sucked so that the idling speed can attain a target value. In the case of the automotive engine system equipped with such an idling speed control device, arrangement may be made that, in the event that the result of calculation of the actual amount of fuel injected may result in a value not greater than zero, the idle speed control device can be controlled to increase the amount of air being sucked thereby to avoid the possibility that the result of the calculation may give the value not greater than zero.

With the fuel control system of the present invention, at the start of deceleration of the engine, the first control to reduce the amount of fuel to be injected on the basis of the amount of fuel injected at the time of start of movement of the throttle valve towards the closed position is carried out independent of the speed of change of the throttle valve towards the closed position. Therefore, no substantial delay in calculation occur and the control of the amount of fuel to be injected can be executed quickly, thereby avoiding any possible enrichment of the air-fuel mixture.

Also, when the throttle valve resumes a movement towards the open position, the first control is interrupted and, on the other hand, the second control to reduce the amount of fuel based on the amount of change in load on the engine is executed. Therefore, the adjustment of the amount of fuel to be reduced appropriate to the decelerated condition can be accomplished, permitting the air-fuel mixture to be favorably burned within the engine combustion chamber.

Again, if based on both of the first fuel decrement and the amount of change of the throttle opening the second fuel decrement is chosen to be of a value increasing in proportion to an increase in amount of change of the throttle opening, a proper control to reduce the amount of fuel appropriate to the engine operating condition immediately before the deceleration takes place and also to a change in load on theengine during the deceleration can be accomplished, allowing the air-fuel mixture within the engine combustion chamber to burn more favorably and also allowing the engine to quickly respond to a re-acceleration, that is, the acceleration assumed subsequent to the deceleration.

Furthermore, where the result of calculation of the actual amount of fuel injected tends to assume a minus sign, the amount of fuel to be reduced is chosen to be of a value required for the result of such calculation to assume a zero value and, at the same time, the length of time during which the amount of fuel to be injected is reduced is prolonged. By so doing, even though fuel adhering to the inner wall surface of the engine system is separated from the inner wall surface and is then supplied into the engine combustion chamber, the substantial control to reduce the amount of fuel can be accomplished, allowing the air-fuel mixture to retain a proper mixing ratio. In such case, if the idling speed control device is controlled to increase the amount of air sucked, a more favorable control of the air-fuel mixing ratio can be accomplished.

BRIEF DESCRIPTION OF THE DRAWINGS

These and other objects and features of the present invention will become clear from the following description taken in conjunction with a preferred embodiment thereof with reference to the accompanying drawings, in which:

FIG. 6 is a schematic diagram showing a map used in the fuel control system of the present invention to calculate a fuel reduction correction coefficient MGTVOAH1;

FIG. 7 is a schematic diagram showing a map used in the fuel control system of the present invention to calculate a fuel reduction correction coefficient MGNEMAPH1;

FIG. 8 is a schematic diagram showing a map used in the fuel control system of the present invention to calculate a fuel reduction correction coefficient MGTVOA1-2;

FIG. 9 is a schematic diagram showing a map used in the fuel control system of the present invention to calculate a fuel reduction correction coefficient MGNEMAP2; and FIG. 10 is a schematic diagram showing a map used in the fuel control system of the present invention to calculate a fuel reduction correction coefficient TGDMAP2.

DETAILED DESCRIPTION OF THE EMBODIMENT

Figure 1:
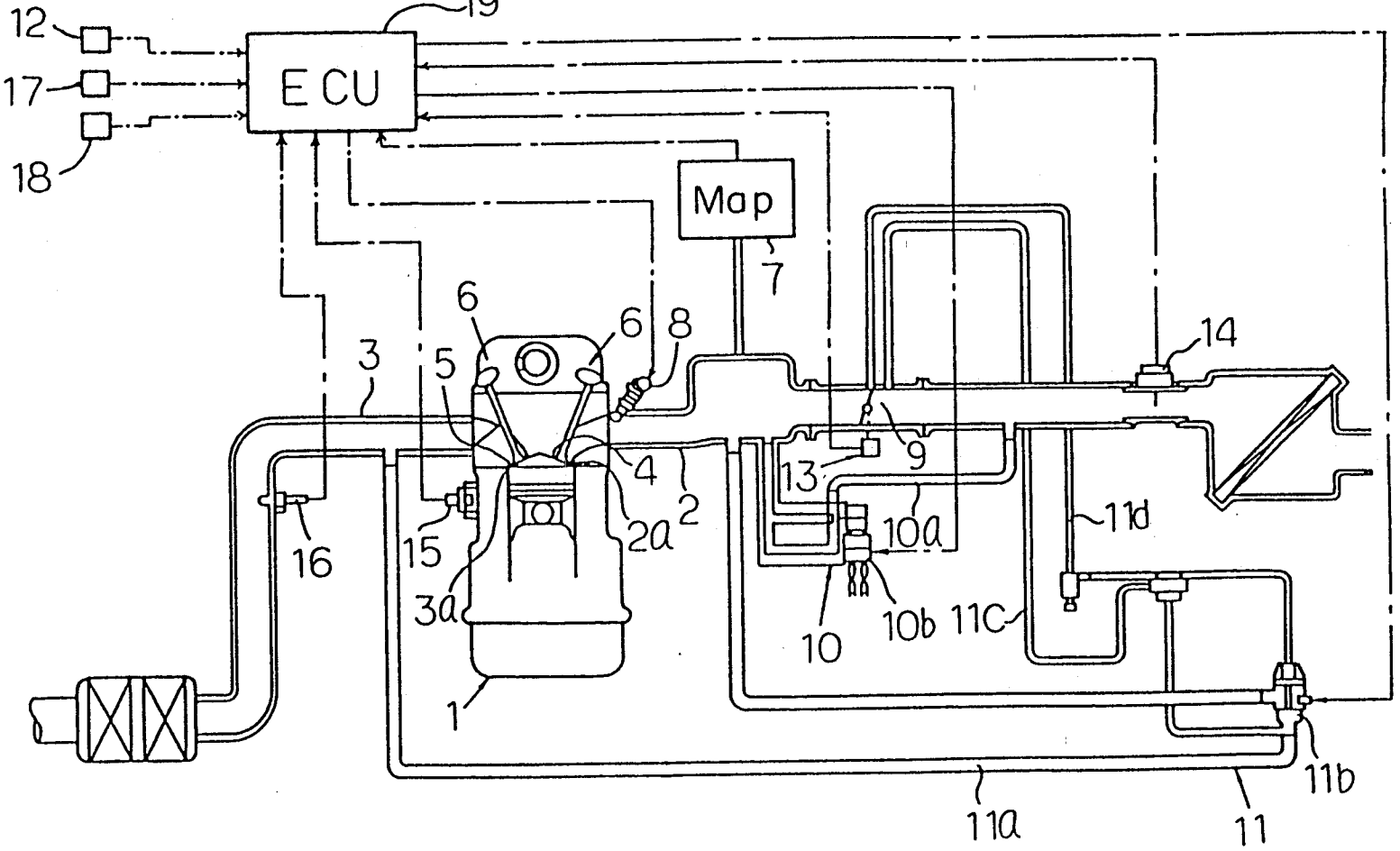
FIG. 1 is a schematic sectional view of an automotive power plant utilizing a fuel control system according to the present invention.

Referring first to FIG. 1, an automotive power plant shown therein comprises an internal combustion engine 1. The engine 1 has a combustion chamber defined therein in any known manner and communicated through an intake port 2*a* with an intake passage 2 and through an exhaust port 3*a* with an exhaust passage 3. As is well known to those skilled in the art, the intake port 2*a* is adapted to be selectively opened and closed by an intake valve 4 and the exhaust port 3*a* is also adapted to be selectively opened and closed by an exhaust valve 5 at a timing generally opposite to the timing of closure or opening of the intake port 2*a*. The opening and closing of each of the intake and exhaust ports 2*a* and 3*a* is in practice controlled in any known manner by a respective cam mechanism 6 which is synchronously driven by the engine 1 in any known manner to drive the intake or exhaust valve 4 or 5.

The intake passage 2 includes a fuel injector 8 for injecting fuel into the combustion chamber through the intake port 2*a* and, also, a throttle valve 9 disposed upstream of the fuel injector 8 with respect to the direction of flow of air towards the combustion chamber, said throttle valve 9 being capable of assuming one of full open and substantially closed positions in response to the position of a well-known foot-operated accelerator pedal (not shown). The intake passage 2 has a bypass passage 10*a* bypassing the throttle valve 9 and including an idling speed control valve 10*b*. The bypass passage 10*a* and the idling speed control (ISC) valve 10*b* altogether constitute a idling speed control unit 10 operable to adjust the amount of air by regulating the idling speed control valve 10*b* during an idling operation of the engine 1 so that the engine speed can be controlled to a predetermined value appropriate to the idling operation.

The illustrated automotive power plant also comprises an exhaust gas recirculating (EGR) system 11. This EGR system 11 comprises an EGR passage 11*a* extending from the intake passage 2 to the exhaust passage 3 while bypassing the combustion chamber in the engine 1, an EGR valve assembly 11*b* disposed on the EGR passage 11*a*, and a parallel circuit of suction passages 11*c* and 11*d* through which a negative pressure necessary to selectively open and close the EGR valve assembly 11*b* can be supplied to the EGR valve assembly 11*b*. As is well known to those skilled in the art, the EGR system 11 operates to recirculate a portion of exhaust gases within the exhaust passage 3 back to the intake passage 2 to control the state of combustion taking place within the combustion chamber.

The amount of fuel injected by fuel injector 8 into the combustion chamber, the ignition timing, the idling speed and the amount of the exhaust gases to be recirculated from the exhaust passage 4 to the intake passage 2 are all controlled by a control unit (ECU) 19. More specifically, this control unit 19 is adapted to receive a rpm signal indicative of the engine speed detected by an rpm sensor 12, a throttle signal indicative of the opening of the throttle valve 9 detected by a throttle sensor 13, an air signal indicative of the amount of air flowing through the intake passage 2 and detected by an airflow sensor 14, a coolant temperature signal indicative of the temperature of a coolant water used to cool the engine 1 and detected by a temperature sensor 15, an oxygen signal indicative of the concentration of oxygen in the exhaust gases detected by an oxygen sensor 16, an air temperature signal indicative of the temperature of the air being sucked which is detected by an air temperature sensor 17, and a pressure signal indicative of the atmospheric pressure detected by a pressure sensor 18.

As will be described later, upon receipt of these signals from the various sensors 12 to 18, the control unit 19 performs an intended calculation and then, based on a result of the calculation, provides drive signals to the fuel injector 8, the idling speed control valve 10*b* and the EGR valve assembly 11*b*, respectively. Specifically, the control unit 19 operates to control the EGR valve assembly 11*b* in dependence on an engine operating condition to recirculate that portion of the exhaust gases to the intake passage 2 thereby to control the state of combustion taking place within the combustion chamber, to control the ISC valve 10*b* in dependence on the engine speed during the idling operation, and to provide fuel injector 8 with a drive signal in dependence on the engine operating condition represented by the amount of air being sucked, the engine speed, the temperature of the air being sucked, the coolant temperature, and the atmospheric pressure.

The automotive power plant so far described above is well known to those skilled in the art and may be of any known construction. However, in accordance with the present invention, the control unit 19 is also operable to determine, and control the fuel injector 8 so as to reduce the fuel by, a first amount of fuel to be reduced (which is hereinafter referred to as a first reducing amount of fuel) in dependence on the amount of fuel injected at the start of movement of the throttle valve towards the closed position during the deceleration of the engine regardless of a speed of movement of the throttle valve towards the closed position; to interrupt the determination of the first reducing amount of fuel at the time when the rate of change of the throttle valve towards the closed position attains a zero value; and thereafter to determine, and control the fuel injector 8 so as to reduce the fuel by, a second amount of fuel to be reduced, i.e., a second reducing amount of fuel, in dependence on a change in load on the engine.

The operation of the fuel control system of the present invention will now be described with reference to FIGS. 2 to 10.

Assuming that the engine 1 is being operated, all of the rpm signal indicative of the engine speed, the throttle signal indicative of the opening of the throttle valve 9, the air signal indicative of the amount of air flowing through the intake passage 2, the coolant temperature signal indicative of the temperature of the coolant water used to cool the engine 1, the oxygen signal indicative of the concentration of oxygen contained in the exhaust gases, the air temperature signal indicative of the temperature of the air flowing through the intake passage 2, and the pressure signal indicative of the atmospheric pressure are supplied to the control unit 18 from the rpm sensor 12, the throttle sensor 13, the air-flow sensor 14, the temperature sensor 15, the oxygen sensor 16, the air temperature sensor 17 and the atmospheric pressure sensor 18, respectively.

Upon receipt of those signals from the various sensors 12 to 18, the control unit 19 executes a calculation to determine, and then output respective control signals indicative of, the amount of fuel to be injected, the fuel injecting timing, the ignition timing, the idling speed desired to be attained, and the amount of the exhaust gases to be actually recirculated into the intake passage 2, all of which are appropriate to a particular engine operating condition. The control signals emerging from the control unit 19 are sequentially applied to the fuel injector 8 to cause the latter to inject the fuel into the combustion chamber in a quality appropriate to the particular engine operating condition at the proper fuel injecting timing; to an ignition distributor to cause an ignition coil in the distributor to generate a high voltage to be applied to the ignition plug thereby to ignite an air-fuel mixture within the combustion chamber; to the idling speed control valve 10*b* of the idling speed control unit 10 during an idling operation of the engine so that the engine speed can attain the desired idling speed; and to the EGR valve assembly 11*b* to cause the latter to supply the required amount of the exhaust gases into the intake passage 2. The foregoing operation is well known to those skilled in the art and, therefore, no further detail thereof is herein reiterated for the sake of brevity.

The control unit 19 is also operable to perform a calculation necessary to determine both the amount of fuel to be injected into the combustion chamber and the timing at which the fuel is to be injected into the combustion chamber which are appropriate to a particular engine operating condition. Based on this calculation, the control unit 19 generates a control signal corresponding to the result of the calculation, which signal is in turn applied to the fuel injector 8 at a predetermined timing to cause the injector 8 to inject into the combustion chamber a quantity of fuel appropriate to such particular engine operating condition.

During the calculation of the amount of the fuel to be injected, a correction is carried out to reduce the amount of fuel to be injected by a decrement required during the deceleration of the engine 1. In other words, the control unit 19 calculates a first fuel decrement, by which the amount of fuel to be injected is reduced, on the basis of the amount of fuel being injected at the time of movement of the throttle valve 9 towards the closed position during the deceleration of the engine, and also calculates a second fuel decrement, by which the amount of fuel being injected is reduced, on the basis of the first fuel decrement and the amount of change of the throttle opening which takes place subsequent to the start of movement of the throttle valve 9 towards the closed position and until the throttle valve 9 ceases its movement. This second fuel decrement increases with an increase of the amount of change of the throttle opening.

It is, however, to be noted that, if a result of the calculation of the amount of fuel actually injected gives a value not greater than zero, the control unit 19 calculates a length of time over which the control to reduce the amount of the fuel is extended, and, also, the opening of the ISC valve 10*a*.

Immediately after the deceleration of the engine 1, the control unit 19 applies the control signal necessary to reduce the amount of the fuel by the first fuel decrement to the fuel injector 8 to cause the latter to inject the amount of fuel which has been reduced by the first fuel decrement, thereby accomplishing a quick correction of the amount of the fuel being injected into the combustion chamber.

Upon termination of the movement of the throttle valve towards the closed position with the rate of change of the throttle valve being consequently zero, the calculation for the determination of the first fuel decrement is interrupted and the control unit 19 subsequently applies the control signal necessary to reduce the amount of the fuel by the second fuel decrement to the fuel injector 8 to cause the latter to inject the fuel in a quantity appropriate to the amount of change in load imposed on the engine 1.

Should the engine 1 be operated in a operating condition in which the amount of air being sucked is small, for example, in an idling condition, and in the event that the result of calculation of the amount of fuel actually injected gives a value not greater than zero consequent upon the deceleration of the engine 1, not only is the length of time during which the amount of the fuel to be injected is reduced prolonged, but also the control unit 19 applies the control signal to the ISC valve 10*a* to cause the latter to open to increase the amount of air being sucked through the intake passage 2, thereby to avoid the possibility that the result of calculation of the amount of the fuel actually injected may give a value not greater than zero.

Figure 2:
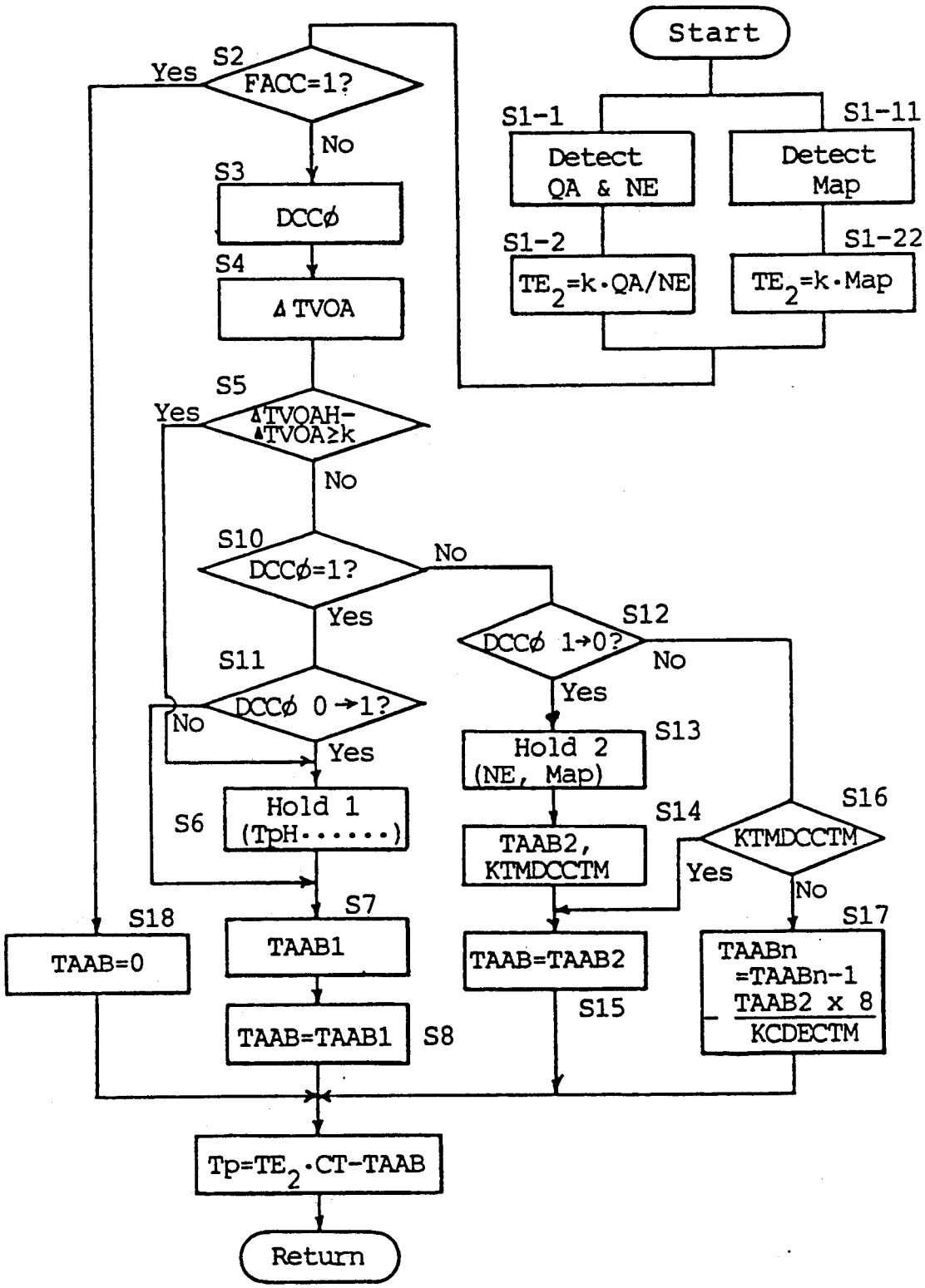
FIG. 2 is a flowchart showing the sequence of a process of calculating the amount of fuel to be reduced, which is performed by the fuel control system of the present invention.
Figure 3:
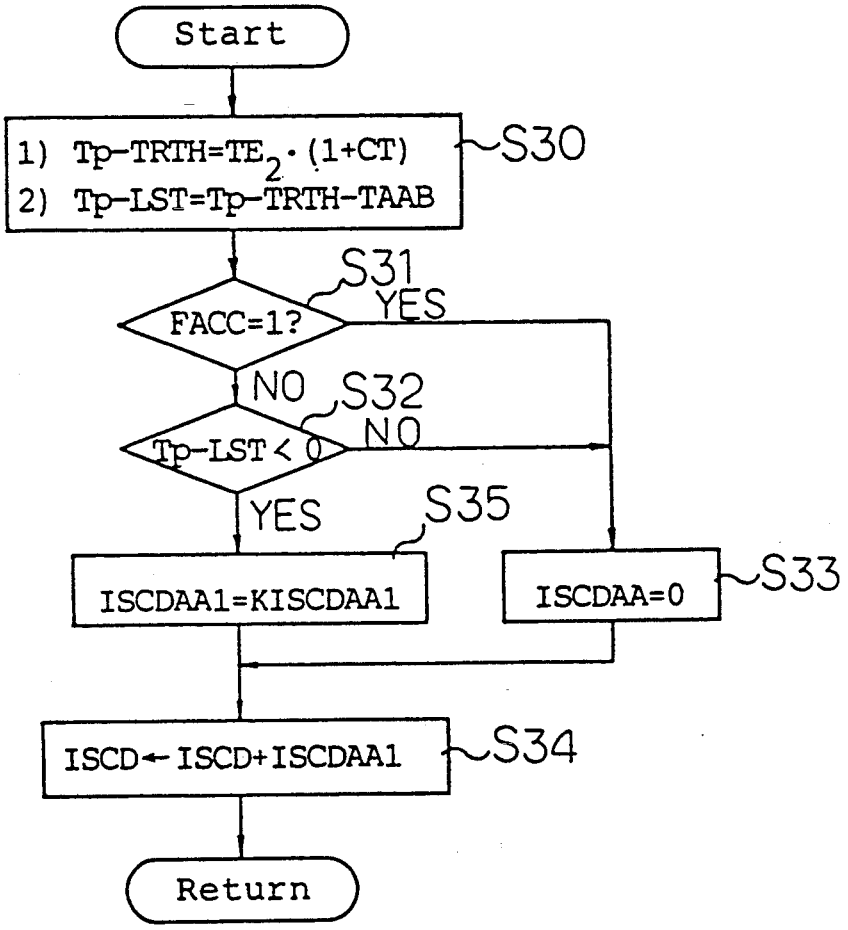
FIG. 3 is a flowchart showing the sequence of a process of calculating the amount of air to be increased, which is performed by the fuel control system of the present invention.
Figures 4, 5:
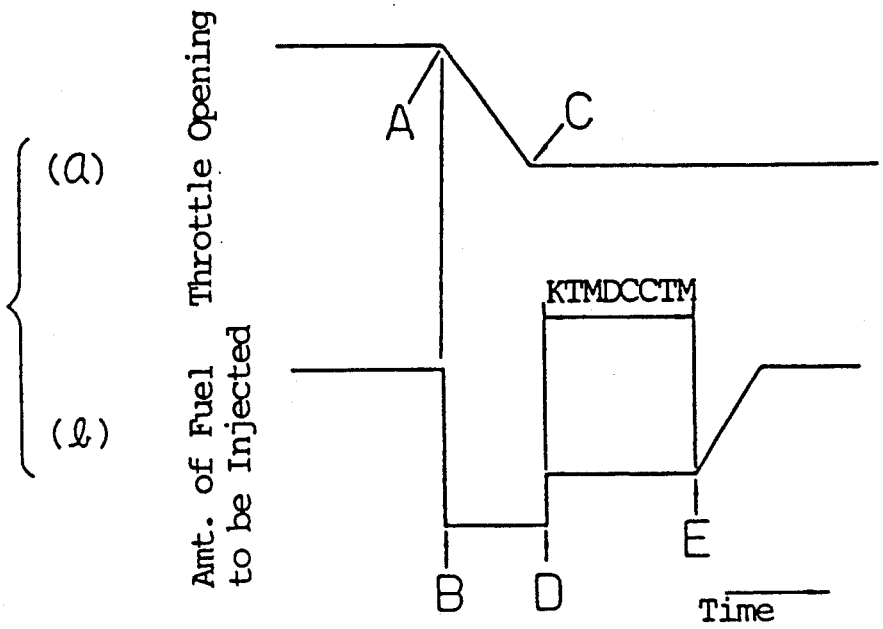
FIG. 4 is a timing chart showing a relationship between a change in throttle opening and a change in amount of fuel injected.
FIG. 5 is a schematic diagram showing a map used in the fuel control system of the present invention to calculate a fuel reduction correction coefficient TGTVOA1-2.

Referring now to FIGS. 2 to 10, the details of the flow for the fuel control accomplished by the fuel control system of the present invention will be described. Specifically, FIG. 2 illustrates a flow of the control for the determination of the amount of fuel which is cyclically performed at intervals of a predetermined module time, for example, 8 msec. FIG. 3 illustrates a flow of the control effected to the ISC valve 10*a*; FIGS. 4(*a*) and 4(*b*) illustrate a timing chart showing both of a change in throttle opening and a change in amount of fuel injected with respect to the passage of time; and FIGS. 5 to 10 illustrates various maps used during the calculation of the amount of fuel to be reduced.

Referring first to FIG. 2, subsequent to the start of the flow for each cycle of determination of the amount of fuel to be injected, and in the event that the amount of air QA being sucked and the engine speed NE have been detected at step S1-1, the ratio $TE_2$ of the air amount QA relative to the engine speed NE, that is, $TE_2 = k \cdot QA/NE$, is calculated at step S1-2, followed by step S2. On the other hand, in the event that a map descriptive of a particular ratio of the amount of air being sucked and the amount of fuel appropriate to the amount of air is detected by a map detector 7 (FIG. 1) at step S1-11, the ratio $TE_2$ of the air amount QA relative to the engine speed NE, that is, $TE_2 = k \cdot QA/NE$, is calculated referring to the detected map at step S1-22 and, then, step S2 follows. It is to be noted that the map detector 7 referred to above is employed in the form of a pressure sensor operable to detect the pressure inside the intake passage 2.

At step S2 subsequent to either step S1-2 or step S1-22, a decision is made to determine if a fuel reducing flag FACC is "1". Since the fuel reducing flag FACC is set to "0" at the start of deceleration of the engine 1, the amount ΔTVOA of change of the throttle opening is compared with a constant K1 (or K2 in the case where a transmission gear MTGR is held in a neutral position). Thereafter, a calculation of a reduction determining flag DCCϕ is carried out at step S3 in such a way that, where the comparison between the amount ΔTVOA of change of the throttle opening and the constant K1 or K2 indicates that the amount ΔTVOA of change of the throttle opening is greater or smaller than the constant K1 or K2, a reduction determining flag DCCϕ is rendered to be 1 or 0, respectively. It is, however, to be noted that, at the start of the flow for each cycle of determination of the amount of fuel to be injected, the determining flag DCCϕ is set to be 0.

At step S4, the amount ΔTVOA of change of the throttle opening is calculated. Then, a difference between the calculated amount ΔTVOA and a hold value ΔTVOAH for the amount of change of the throttle opening is compared with a constant K at step S5 to determine whether an abrupt deceleration of the engine takes place or whether a moderate deceleration of the engine takes place. Where the engine is abruptly decelerated, respective hold values for the basic amount TpH of fuel to be injected, a constant KTpH and the amount ΔTVOA of change of the throttle opening are updated at step S6, followed by step S7 at which the first fuel decrement TAAB1 is determined using the following equation (1).

$$TAAB1 = TpH \times KTpH \times MGTVOH1 \times MGNEMAPH1 \quad (1)$$

wherein TpH represents a hold value for the basic amount of fuel to be injected before the start of deceleration, that is, at the time the reduction determining flag DCCϕ has changed from 0 to 1; KTpH represents a hold value for a correction constant; MGTVOH1 represents a correction coefficient for the throttle opening which is calculated in reference to such a map as shown in FIG. 6, using the hold value TVOAH1 for the throttle opening immediately before the start of deceleration and the hold value ΔTVOAH1 for the amount of change of the throttle opening immediately before the start of deceleration; and MGNEMAPH1 represents a first deceleration correction coefficient which is calculated in reference to such a map as shown in FIG. 7, using the hold value NEH1 for the engine speed immediately before the start of deceleration and the hold value MAPH1 for the negative pressure developed inside the intake passage 2 immediately before the start of deceleration.

Once the first fuel decrement TAAB1 has been calculated, a fuel decrement TAAB is written over by the first fuel decrement TAAB1 at step S8 and, then, at step S9, the amount To of fuel to be injected is calculated using the following equation so that the control signal of a pulse width corresponding to the calculated amount of fuel to be injected can be applied to the fuel injector 8.

$$Tp = TE2 \times CT - TAAB \quad (2)$$

In the equation (2) above, Tp represents the pulse width; TE2 represents the basic amount of fuel to be injected which is determined by the ratio Qa/NE (Qa being the amount of air being sucked through the intake passage 2 and NE being the engine speed); and CT represents a constant determined by the temperature of air detected by the air temperature sensor 17, the coolant temperature detected by the coolant temperature sensor 15 and the pressure detected by the pressure sensor 18.

Thus, in the event of the abrupt deceleration taking place in the engine 1, the program flow from step S2 to step S9 takes place subsequent to either step S1-2 or step S1-22 and, during the execution of this program flow, the amount of fuel to be actually injected shortly before the start of deceleration is reduced by updating the hold value for the first fuel decrement as shown at timings A and B in FIG. 4.

Referring to step S4, where the difference between the calculated amount ΔTVOA and the hold value ΔTVOAH for the amount of change of the throttle opening smaller than the constant K, that is, in the event of the moderate deceleration taking place in the engine, a decision is made at step S10 to determine if the determining flag DCCϕ is 1. Since this determining flag DCCϕ is set to 1 during the deceleration of the engine, the next succeeding decision is made at step S11 to determine if it is immediately after the determining flag DCCϕ has just changed from 0 to 1. If it is immediately after the determining flag DCCϕ has just changed from 0 to 1, the hold values are updated at step S6, but if it is not immediately after the determining flag DCCϕ has changed from 0 to 1, the flow of steps S8 and S9 takes place so that, at the time of start of the moderate deceleration of the engine, the updating of the hold values for the first correction of the amount of fuel to reduce the latter by the first fuel decrement is followed by the injection of the fuel in a quantity corresponding to the amount of fuel injected shortly before the start of deceleration less the first fuel decrement as shown at the timings A and B in FIG. 4.

Subsequent to this first fuel correction, and in the event that the amount of change of the throttle opening attains a zero value as shown at a timing C in FIG. 4, the reduction determining flag DCCϕ is set to 0 and, therefore, a decision is made at step S12 to determine if it is immediately after the determining flag DCCϕ has just changed from 0 to 1. If it is immediately after the determining flag DCCϕ has just changed from 0 to 1, the respective values for the engine speed NE and the negative pressure MAP, which are used during a second fuel correction to reduce the amount of fuel to be injected by the second fuel decrement, are updated at step S13, followed by step S14 at which, using the following equations (3) and (4), the second fuel decrement TAAB2 and the length of time (fuel reduction time) KTMDCCTM during which the fuel reduction is to be effected are calculated.

$$TAAB2 = TAAB1 \times (TGTVOAH1 - 2) \quad (3)$$

$$KTMDCCTM = (MGTVOA1 - 2) \times MGNEMAP2 \quad (4)$$

In the equation (3) above, (TGTVOAH1 − 2) represents a first load correction coefficient calculated with the use of a map as shown in FIG. 5 in dependence on the difference (descriptive of the amount of change of the engine load) between the hold value TVOAH1 for the throttle opening shortly before the start of the deceleration and the hold value TVOAH2 for the throttle opening at the time the determining flag DCCϕ has changed from 1 to 0, that is, at the termination of change of the throttle opening. The greater the amount of change of the engine load (TVOAH1 − TVOAH2), the higher the first load correction coefficient.

In the equation (4) above, (MGTVOA1 − 2) represents a second load correction coefficient calculated with the use of such a map as shown in FIG. 8 in dependence on the difference (TVOAH1 − TVOAH2) between the respective hold values for the throttle opening at the time of start of the deceleration and at the termination of change of the throttle opening, and also on the hold value TVOAH2 for the throttle opening at the termination of change of the throttle opening; MGNEMAP2 represent a second deceleration correction coefficient calculated with the use of such a map as shown in FIG. 9 in dependence on the hold value NEH2 for the engine speed at the termination of change of the throttle opening and the hold value MAPH2 for the negative pressure at the termination of change of the throttle opening; and TGDMAP2 represents a negative pressure correction coefficient calculated with the use of such a map as shown in FIG. 10 in dependence on the hold value MAPH1 for the negative pressure shortly before the start of deceleration and the hold value MAPH2 for the negative pressure at the termination of change of the throttle opening.

After the second fuel decrement TAAB2 and the fuel reduction time KTMDCCTM have been calculated in the manner as hereinabove described, the fuel decrement TAAB is written over by the second fuel decrement TAAB2 at step S15 and, then, the amount of fuel Tp to be injected is calculated using the equation (2) at step S9 so that the control signal of a pulse width corresponding to the calculated amount of fuel to be injected can be applied to the fuel injector 8 for the fuel reduction time KTMDCCTM.

As described above, when the rate of change of the throttle opening becomes zero, the first control to decrease the amount of fuel to be injected is interrupted and, instead, the second control TAAB2 to decrease the amount of fuel appropriate to the amount of change of the load on the engine is carried out for the fuel reduction time KTMDCCTM appropriate to the change in load on the engine. Also, in the event that the result of calculation of the amount of fuel actually injected attains a value not greater than zero, the length of time during which the amount of fuel to be injected is prolonged.

After the fuel reduction time KTMDCCTM has passed as indicated by timings D and E in FIG. 4 as determined at step S16, a third fuel decrement TAABn is calculated at step S17 using the following equation (5) and, then, the amount of fuel Tp to be injected is calculated using the equation (2) at step S9 so that the control signal of a pulse width corresponding to the calculated amount of fuel to be injected can be applied to the fuel injector 8.

$$TAABn = (TAABn - 1) - (TAAB2 \times 8/KGDECTM) \quad (5)$$

wherein TAABn≧0; the numeral 8 represents the length of time during which the control unit 19 performs calculation, expressed in unit of millisecond; and KGDEC represents a predetermined time which may be chosen to be, for example, 300 millisecond.

After the termination of the control to reduce the amount of fuel to be injected, the reduction flag FACC1 is set to 0 and, at the same time, the fuel decrement TAAB is set to 0 at step S19, allowing the fuel injector 8 to inject the fuel in a quantity appropriate to the particular engine operating condition.

On the other hand, during the control of the ISC valve **10*b* as shown in FIG. 3, and at step S30**, not only is the pulse width (Tp − TRTH) determinative of the amount of fuel to be injected calculated using the following equation (7), but also the actual pulse width (Tp − LST) determinative of the amount of fuel being injected is calculated using the following equation (8).

$$(Tp - TRTH) = TE2 \times (1 + CT) \quad (7)$$

$$(Tp - LST) = (Tp - TRTH) - TAAB \quad (8)$$

Then, at step S31, a decision is made to determine if the reduction flag FACC is 1, followed by a decision at step S32 to determine if the pulse width (Tp − LST) gains a minus sign or a plus sign.

Where the reduction flag FACC is 1, and if the pulse width (Tp − LST) is of a plus sign, it means that the increase of the amount of air being sucked is no longer necessary and, therefore, the air increment ISCDAA1 is set to 0 at step S33, allowing the control unit 19 to apply to the ISC valve **10*b* the control signal ISCD necessary to control the idling speed to a standard or ordinary value at step S34. In response to this control signal ISCD, the ISC valve 10*b* is opened to effect the supply of air bypassing the throttle valve 9**, thereby to control the idling speed to a predetermined value.

Where the reduction flag FACC is 0, that is, where the amount of fuel to be injected is to be reduced and, at the same time, the amount of air being sucked is required to be increased, an air increment ISCDAA1, i.e., the amount by which the amount of air being sucked is to be increased, is set with a predetermined value KISCDAA1 at step S35 and, then, using the following equation (9), the control signal ISCD necessary to control the idling speed to the standard or ordinary value and also to increase the amount of air being sucked is calculated at step S34.

$$ISCD = ISCD + ISCDAA1 \quad (9)$$

In this way, the ISC valve 10*b* is, in response to the control signal ISCD, opened to an opening greater by a predetermined value than the opening of the ISC valve 10*b* which is assumed during the control of the idling speed to the standard or ordinary value, thereby controlling the engine 1 to be operated at a predetermined idling speed while the amount of air being sucked is increased. In other words, the possibility that the result of actual calculation of the amount of fuel to be injected may gain a minus sign can be avoided.

As hereinbefore described, the fuel control system of the present invention is so designed that the first control to reduce the amount of fuel to be injected into the combustion chamber of the engine can be carried out at the time of start of deceleration of the engine in dependence on the amount of fuel being injected at the time of start of change of the throttle opening. Therefore, not only can the actual reduction of the amount of fuel to be injected take place quickly with no delay which would otherwise occur due to a characteristic delay time of the control unit, but also, the amount of fuel to be injected can be quickly reduced, thereby minimizing the possible failure of the air-fuel mixture to burn or the possible occurrence of the afterburning.

The fuel control system of the present invention is also so designed that the first control referred to above can be interrupted at the time the quantity of change of the throttle opening becomes zero and, on the other hand, the second control to reduce the amount of fuel to be injected into the combustion chamber can be carried out in dependence on the amount of change of the load on the engine. This second control permits the air-fuel mixture within the combustion chamber to exhibit a favorable combustion. Also, the calculation or determination of the first fuel decrement and the second fuel decrement in dependence on the amount of change of the throttle opening allows a proper reduction in amount of fuel to be injected to be accomplished in dependence on the engine operating condition prior the deceleration taking place and the change in load during the deceleration and, therefore, the combustion of the air-fuel mixture within the combustion chamber takes place favorably accompanied by an improvement in response during a reacceleration, i.e., the acceleration which takes place subsequent to the deceleration.

Furthermore, the fuel control system of the present invention is so designed that, when the engine is operated in the condition in which the amount of air being sucked is small such as during the idling condition, the fuel reduction time during which the amount of fuel to be injected is reduced can be prolonged in the event that the result of calculation of the amount of fuel actually injected appears to assume a minus sign and, on the other hand, the amount of air being sucked can be increased, thereby to avoid the possibility that the result of calculation may assume the minus sign. Therefore, the substantial control to reduce the amount of fuel to be injected can be accomplished with minimization of any adverse influence which would be brought about by fuel adhering to the inner wall surface.

Although the present invention has been described in connection with the preferred embodiment thereof with reference to the accompanying drawings, it is to be noted that various changes and modifications are apparent to those skilled in the art without departing from the spirit of the present invention. Such changes and modifications are to be understood as included within the scope of the present invention as defined by the appended claims unless they depart therefrom.

What is claimed is:

1. In an automotive power plant including a combustion engine having at least one combustion chamber, an intake passage means communicated with the combustion chamber through at least one valve-controlled intake port for an introduction of an air-fuel mixture into the combustion chamber, an exhaust passage means communicated with the combustion chamber through at least one valve-controlled exhaust port for a discharge of exhaust gases from the combustion chamber, a fuel injector for injecting a controlled amount of fuel into the combustion chamber together with air sucked through the intake passage means, and a throttle valve disposed in the intake passage means upstream of the fuel injector with respect to the direction of flow of the air towards the combustion chamber, said throttle valve being displaceable between a full open position and a substantially closed position for controlling the flow of the air through the intake passage means, a fuel control system for determining the amount of fuel to be injected into the combustion chamber in dependence on the amount of air being sucked towards the combustion chamber, said fuel control system comprising:

a throttle sensing means for detecting, and providing a throttle signal indicative of, the opening of the throttle valve; and a control means operable to determine, and control the fuel injector so as to reduce the amount of fuel to be injected by, a first fuel decrement in dependence on the amount of fuel injected at the start of movement of the throttle valve towards the closed position during a deceleration of the engine when the throttle sensing means detects the movement of the throttle valve towards the closed position at a speed higher than a predetermined value and regardless of a speed of movement of the throttle valve; to interrupt the determination of the first fuel decrement when the rate of change of the throttle valve towards the closed position attains a zero value; and thereafter to determine, and control the fuel injector so as to reduce the fuel by a second fuel decrement in dependence on a change in load on the engine.

2. The fuel control system as claimed in claim 1, wherein, based on the amount of fuel to be reduced represented by the first fuel decrement and the amount of change in throttle opening subsequent to the start of the change thereof and until the termination of the change thereof, the amount of fuel represented by the second fuel decrement is chosen to increase in proportion to an increase of the amount of change of the throttle opening, and wherein the amount of fuel to be injected is reduced by the second fuel decrement after the change in throttle opening terminates.

3. The fuel control system as claimed in claim 1, wherein, where a result of calculation of the actual amount of fuel injected based on a result of calculation of one of the first and second fuel decrements tends to assume a value not greater than zero during a particular engine operating condition wherein the amount of air being sucked is small, said fuel decrement is chosen to be of a value effective to render the result of calculation to give a zero value and, at the same time, a length of time during which the amount of fuel to be injected is reduced is prolonged.

4. The fuel control system as claimed in claim 2, wherein, where a result of calculation of the actual amount of fuel injected based on a result of calculation of one of the first and second fuel decrements tends to assume a value not greater than zero during a particular engine operating condition wherein the amount of air being sucked is small, said fuel decrement is chosen to be of a value effective to render the result of calculation to give a zero value and, at the same time, a length of time during which the amount of fuel to be injected is reduced is prolonged.

5. The fuel control system as claimed in claim 1, further comprising an idling speed control device, and wherein, where a result of calculation of the actual amount of fuel injected based on a result of calculation of one of the first and second fuel decrements assumes a value not greater than zero, said fuel control system controls the idling speed control device to increase the amount of air being sucked through the intake passage means.

6. The fuel control system as claimed in claim 2, further comprising an idling speed control device, and wherein, where a result of calculation of the actual amount of fuel injected based on a result of calculation of one of the first and second fuel decrements assumes a value not greater than zero, said fuel control system controls the idling speed control device to increase the amount of air being sucked through the intake passage means.

7. The fuel control system as claimed in claim 1, wherein said first fuel decrement by which the amount of fuel to be injected is reduced at the start of deceleration of the engine is determined in reference to the second fuel decrement.

8. The fuel control system as claimed in claim 3, wherein said particular engine operating condition is an idling condition.

9. The fuel control system as claimed in claim 4, wherein said particular engine operating condition is an idling condition.

* * * * *